United States Patent [19]

Dreyfus

[11] Patent Number: 4,715,493

[45] Date of Patent: Dec. 29, 1987

[54] COMPOSITE PACKAGE FOR A GROUP OF CONTAINERS

[75] Inventor: Roger Dreyfus, Strasbourg, France

[73] Assignee: ICP S.A., Fegersheim, France

[21] Appl. No.: 923,337

[22] Filed: Oct. 27, 1986

[51] Int. Cl.[4] ..... B65D 5/46

[52] U.S. Cl. ..... 206/200; 206/428; 206/427; 229/52 BC; 229/52 AL

[58] Field of Search ..... 206/427, 428, 434, 200; 229/52 AC, 52 AL, 52 BC, 52 R, 52 A, DIG. 6

[56] References Cited

U.S. PATENT DOCUMENTS

| | | | |
|---|---|---|---|
| 241,525 | 5/1881 | Buckingham | 229/52 AC |
| 3,030,002 | 4/1962 | Ringler | 229/52 AL |
| 3,245,527 | 4/1966 | Martin | 206/427 |
| 3,841,476 | 10/1974 | Elford | 206/427 |
| 4,301,922 | 11/1981 | Hamelin et al. | 229/52 AC |
| 4,482,090 | 11/1984 | Milliens | 206/427 X |
| 4,546,914 | 10/1985 | Roccaforte | 206/427 X |
| 4,625,864 | 12/1986 | Nigrelli | 206/427 |

FOREIGN PATENT DOCUMENTS

| | | | |
|---|---|---|---|
| 66029 | 12/1982 | European Pat. Off. | 206/427 |
| 2096972 | 10/1982 | United Kingdom | 206/427 |

*Primary Examiner*—Stephen Marcus

*Assistant Examiner*—T. Graveline

*Attorney, Agent, or Firm*—Erwin S. Teltscher

[57] ABSTRACT

A composite package for a group of articles includes a substantially tray-shaped bottom portion having a bottom wall and a plurality of upstanding edge walls which include a front edge wall and a rear edge wall having respective upper edges and which confine the group of articles supported on the bottom wall between themselves. A cover portion is connected to the bottom portion in an assembled condition of the package to cover the bottom portion and the group of articles. The cover portion includes a front wall including a front panel having an opening and two lugs extending along the front panel in a closed position of the front panel. An elongated endless strap is received in the package and loosely surrounds the group of articles in the assembled condition of the package. The upper edges of the front and rear edge walls are provided with holding projections which hold the strap in position on the bottom portion. The holding projections of the front edge wall define with the lugs, respective slots for the passage of the strap therethrough and through the opening of the front panel between the interior and the exterior of the package in the assembled condition of the package and the closed position of the front panel for the strap to form a handle at the exterior of the package.

8 Claims, 14 Drawing Figures

COMPOSITE PACKAGE FOR A GROUP OF CONTAINERS

BACKGROUND OF THE INVENTION

The present invention relates to packages in general, and more particularly to a composite package for accommodating a group of containers.

Composite packages of the type including a bottom portion of a generally tray-shaped configuration, a peripheral tying member or strap including a handle, and a cover portion which covers the bottom portion and a group or set of articles, such as bottles or other containers, prove to be of interest since the tray-shaped bottom portion, in addition to having the function of supporting the articles, also performs the role of a confining member for the set of articles for packing such articles during the phase of concentration and separation thereof into groups prior to their encirclement and their coverage by the cover portion.

In addition, for cost reasons, there is being utilized more and more the encirclement of a group of containers with the aid of a tying member or strap. The straps which can be currently found in commerce are of the ribbon or sheet type, that is, flat. Such known tying ribbons often are provided at their two major surfaces with a slight embossed profile which is obtained, for instance, by calendering and which provides for an improved mechanical resistance in the longitudinal sense and a good immobilized adherence in the superimposed position.

Thus, the composite package including the tray-shaped bottom portion and involving the encirclement of the group of articles and their coverage by the cover not only fulfils the general conditions and considerations expected thereof, but also offers to the users certain guaranties relating to several basic points, such as the holding of the handle formed by a portion of the strap, the general cohesion of the group of articles and of the package, the facility of seizure by the user and so on.

Even though all of the conditions are simultaneously united in a package having a tray-shaped bottom portion, a cover portion and a peripheral encirclement of the set of the articles, it is not evident how such conditions would be maintained in the case of a loose peripheral confining or tying member or what is involved in all the other known confining processes.

SUMMARY OF THE INVENTION

Accordingly, it is a general object of the present invention to avoid the disadvantages of the prior art.

More particularly, it is an object of the present invention to provide a composite package for a group of articles, which does not possess the drawbacks of the known packages of this type.

Still another object of the present invention is to devise a package of the type here under consideration in which a strap can be easily arranged around the group of articles during the formation of the package, but securely holds the articles together while the package is being carried from one place to another.

It is yet another object of the present invention to design the above package in such a manner that the strap will relieve the remainder of the package of the weight of the articles while the package is being carried.

A concomitant object of the present invention is so to construct the package of the above type as to be relatively simple in construction, inexpensive to manufacture, easy to use, and yet reliable in operation.

In keeping with these objects and others which will become apparent hereafter, one feature of the present invention resides in a composite package for a group of articles, this package comprising a substantially tray-shaped bottom portion having a bottom wall and a plurality of upstanding edge walls which include a front edge wall and a rear edge wall having respective upper edges and which confine the group of articles supported on the bottom wall. The package further includes a cover portion which is connected to the bottom portion in an assembled condition of the package to cover the bottom portion and the group of articles. The cover portion has a front wall which includes a front panel having an opening, and two lugs extending along the front panel in a closed position of the front panel. An elongated endless strap is received in the package and loosely surrounds the group of articles in the assembled condition of the package. The package also includes means provided at the upper edges of the front and rear edge walls for holding the strap in position on the bottom portion, the holding means of the front edge wall bounding with the associated lugs respective slots for the passage of the strap through such slots and through the aforementioned opening of the front panel between the interior and the exterior of the package in the assembled condition of the package and in the closed position of the front panel for the strap to form a handle at the exterior of the package.

A particular advantage of the package construction described so far is that the strap, due to the fact that it is loosely arranged around the group of articles present in the interior of the package, but that it has a portion which is arranged at the exterior of the package and which is to be used as a handle for carrying the package around, causes the carrying forces resulting from carrying the package by the handle to be applied to the group of articles in such a manner as to increase the degree of cohesion of such articles. This avoids any risk of damage to such articles while being carried and reduces the amount of noise caused by the articles banging agains one another, if not eliminating such noise altogether. Also, the strap relieves the remainder of the package of the weight of the articles while the package is being carried by the handle, thus avoiding damage to the remainder of the package and falling of the articles out of the package. Moreover, since the handle is constituted by an integral portion of the strap, the weight of the contents of the package will not be able to dissociate the handle from the package. On the other hand, the bottom portion and the cover portion of the package also participate in or accomplish the confining action of the package on the articles when the strap is not used for carrying the package.

Advantageously, the holding means of the rear edge portion includes a central projection, and the holding means of the front edge portion includes two projections which are separated from one another by an indentation. When the holding means of the front edge portion includes two projections which are separated from one another by an indentation and have respective vertical edges, it is advantageous for each of the lugs to be provided at its lower edge with a cutout having a configuration substantially identical to that of an associated one of the projections for receiving the same and being partially bounded by a vertical edge which defines one of the slots with the vertical edge of the associated projection. It is particularly advantageous when the vertical edge of each of the lugs substantially corresponds to the vertical edge of the associated projection but is spaced therefrom by a distance defining the width of the one slot.

According to an advantageous aspect of the present invention, it is proposed for the aforementioned lugs to have such individual lengths that their cumulative length is smaller than the corresponding dimension of the front wall. The lugs advantageously have such configurations that they bound an open area which is aligned with the indentation of the holding means of the front edge wall. It is currently preferred for the opening of the front panel to include a slot having a centrally located enlargement. The above-mentioned opening of the front panel is partially bounded by an upper edge and each of the lugs has a lower edge which advantageously exactly corresponds to the upper edge of the opening in the closed position of the front panel.

The package of the present invention achieves in particular the following advantages:

the provision of a handle having a high resistance to dissociation from the remainder of the package by making the handle as an integral part of the strap;

the performance of multiple functions by the strap which, in addition to providing the handle, provides the required confining action on the contents of the package, so that the remainder of the package does not participate in the confinement of the articles to any material extent during the carrying of the package by the handle from one location to another;

the facilitation of the packaging operation using existing machinery;

inasmuch as the strap is situated predominantly in the interior of the package, it does not obscure any advertising or identifying material presented at the external, especially lateral, surfaces of the package;

on juxtaposition of a plurality of such packages, the handle assumes its retracted position within the overall outline of the package for storage and palletization, while it is easily displaced into its carrying position for holding of the package during the carrying thereof; and all of the connecting portions of the strap being arranged along the internal perimeter of the package, the strap is left without any rough spots which would otherwise hinder the confining action and the carrying ability.

BRIEF DESCRIPTION OF THE DRAWING

The present invention will be described below in more detail with reference to the accompanying drawing in which.

DETAILED DESCRIPTION OF THE PREFERRED EMBODIMENT

Figure 1:
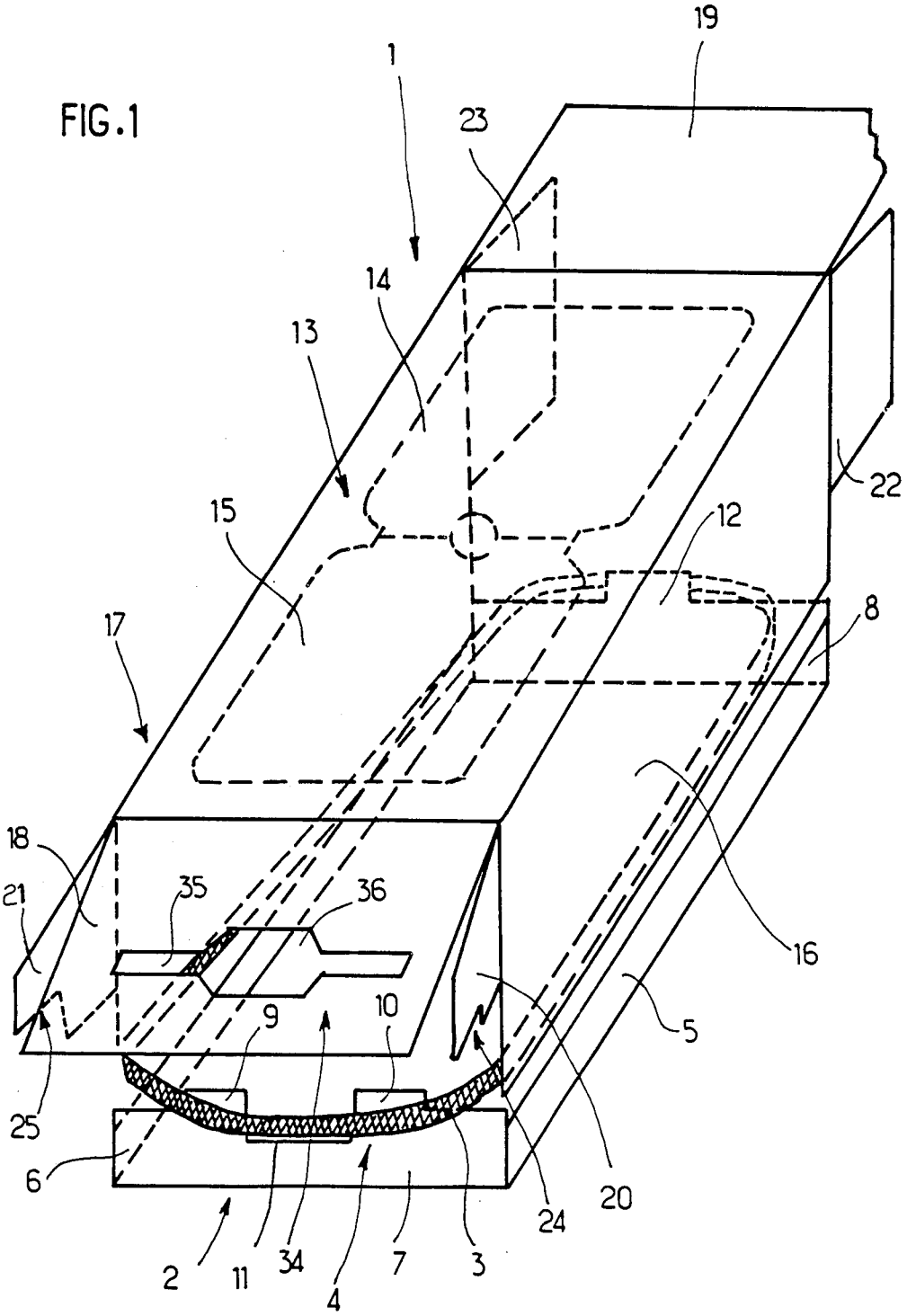
FIG. 1 is a perspective overall view of a package according to the present invention, with the bottom and top parts thereof dissociated from one another, and the ends of the top being open.

Referring now to the drawing in detail, and first to FIG. 1 thereof, it is to be mentioned initially that a general idea of the present invention resides in forming, in a composite package of the type having a tray-shaped bottom and equipped with a unitary confining strap, a handle associated with the strap, and in leaving a certain leeway for the passage of a hand between the strap and the package, in such a manner that the holding of the package by the handle causes the strap to confine and press against the contents of the package.

When describing the contents of the package of the present invention below, it will be referred generally to containers and more particularly to bottles. However, it is to be understood that the reference to the package contents is intended to encompass within its meaning any type of containers or articles, no matter what their shapes and their natures, especially to cylindrical cans and containers having square or other polygonal cross sections.

The package of the present invention includes a lid or cover 1, a generally tray-shaped bottom 2, and a peripheral confining or holding strap 3 which is, for instance, flat and is made of a synthetic plastic material that is known and commercially available. Of course, any other cross-sectional configurations of the strap 3 or any other suitable materials are contemplated by the present invention as well.

The strap 3 forms a loop which is slack. The length of the strap 3 is greater than that of the perimeter of a group of the containers, in such a manner as to form, at one end, a portion which is sufficiently dimensioned to constitute a handle 4.

The tray-shaped bottom 2 includes longitudinal walls 5 and 6, and transverse front and rear walls 7 and 8, respectively. These walls 5 to 8 together form a retaining rim for a group of bottles, and they are to be covered in the assembled condition of the package by corresponding lower edge portions of the cover 1. As indicated before, the bottom 2 performs the role of a conforming device during the packing operation. It receives the group of the bottles and it maintains them in positions at the regions of their bottoms or bases, rendering it possible to assure cohesion of such bottles until the placement of the strap 3 around them and the following positioning of the cover 1 thereon. It will be appreciated that the bottom 2 participates in the achievement of this cohesion until the package is fully constituted.

Figure 2:
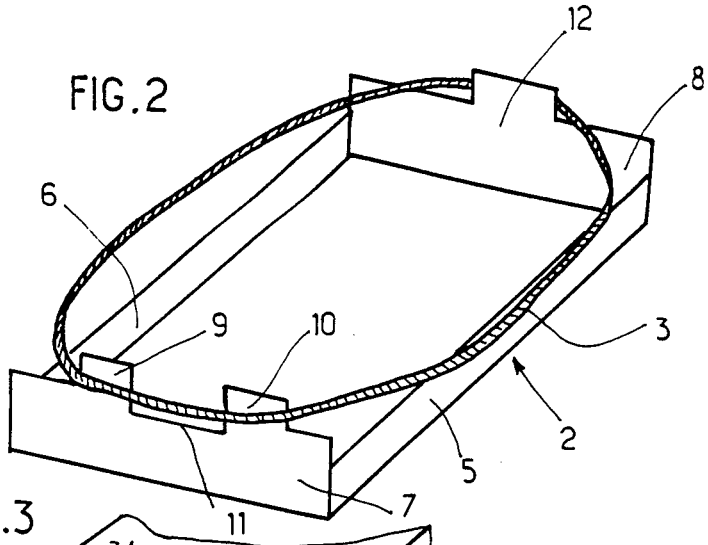
FIG. 2 is a perspective view of the bottom part of the package of FIG. 1, which has a tray-shaped configuration and carries a strap according to the invention.
Figure 3:
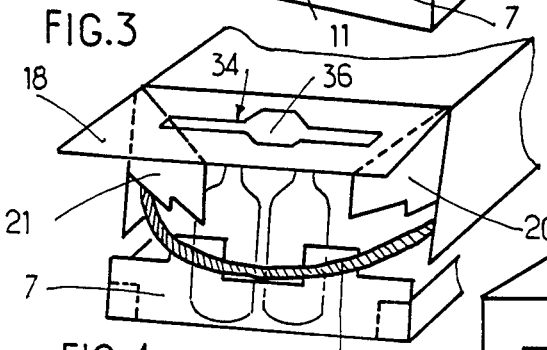
FIG. 3 is a perspective view of a front end portion of the package of FIG. 1 in its condition assumed just prior to closing.

The transverse front edge wall 7 of the bottom 2 is provided with two holding projections 9 and 10 which project upwardly from an upper edge line of the front edge wall 7 and which are separated from one another by an indentation 11. On the other hand, the transverse rear edge wall 8 has a configuration which is non-conforming to that of the front wall 7, in that it has only one holding projection 12 which is situated at the central portion of the rear wall 8. The projections 9, 10 and 12 and those zones of the upper edges of the walls 7 and 8 of the bottom part 2 which adjoin the projections 9, 10 and 12 maintain the strap 3 in a confining position, that is, with the strap 3 extending along the course shown in FIGS. 1 and 2 and with its major surfaces extending vertically.

The cover 1 is made of a sheet material which is rigid or semi-rigid. The cover 1 has a shape which is generally parallelepiped and includes an upper wall 13 which is provided, for example, with access flaps 14 and 15 which have been previously cut out. The cover 1 further includes two lateral walls 16 and 17. The front and the rear ends include a closing panel 18 and 19, respectively, and lateral lugs 20 and 21 for the front wall and 22 and 23 for the rear wall.

The lugs 22 and 23 for the rear wall are of a substantially trapezoidal shape and they are provided solely for the purpose of improving the strength of the rear wall which is sealed by the rear closing panel 19. The lugs 20 and 21 for the front wall are of such lengths that their cumulative length is smaller than the transverse dimension of the front closing panel 18. More particularly, the lengths of the lugs 20 and 21 are reduced in such a manner that in their folded or inwardly pivoted states in which they extend along the plane of the front wall they leave free an area substantially aligned with the indentation 11. The lugs 20 and 21 are provided at their lower regions with respective rectangular cutouts which constitute respective indentations 24 and 25 having configurations that are exactly identical with respect to their shapes and dimensions to the corresponding holding projections 9 and 10.

Figure 9:
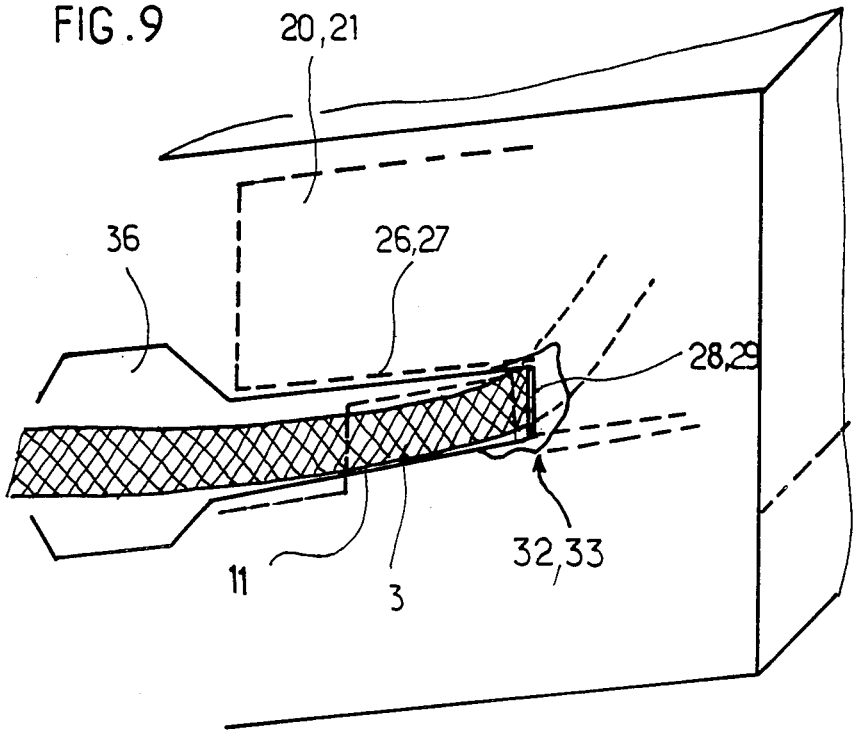
FIGS. 9 and 10 are fragmentary enlarged perspective detail views of the vicinity of a slot provided in a front wall of the front end portion of FIGS. 4 and 5 for the passage of the strap therethrough, with the front panel being removed in FIG. 9 and in place in FIG. 10.
Figure 10:
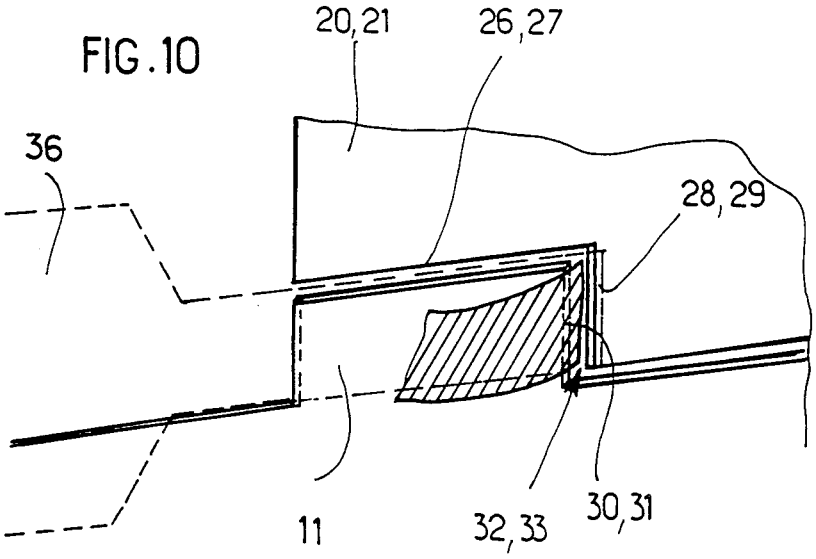
Figure 11:
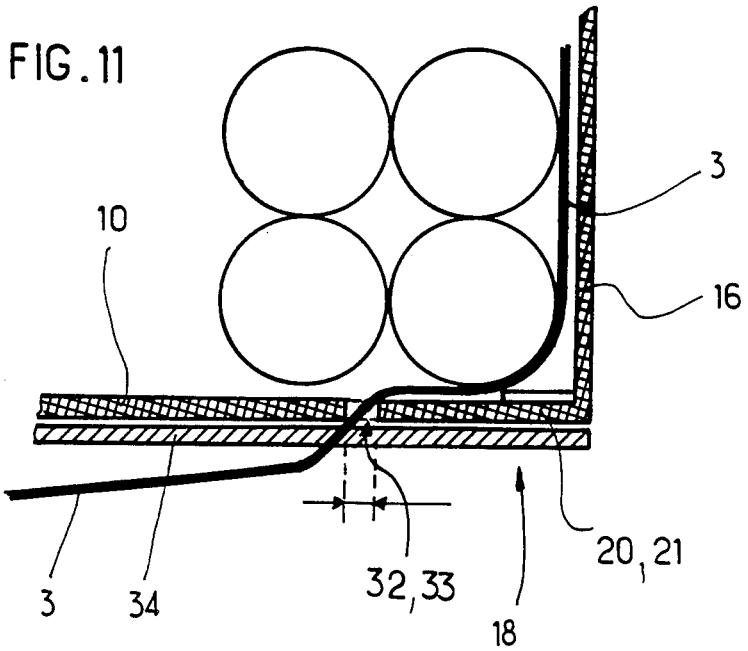
FIGS. 11 and 12 are fragmentary enlarged horizontal sectional views of a region of the slot and of the adjacent corner for a parallelepiped package body and a package body with a bevelled corner section, respectively.

A lower edge 26 or 27 of each of the lugs 20 and 21 for the front wall (see particularly FIGS. 9 and 10) includes a cutout which precisely reproduces in complementary form the configuration of the associated part of the front edge wall 7 of the bottom 1 in such a manner as to form, after the closing, a quasi-continuous panel which is subsequently covered by the front wall closing panel 18. A vertical edge 28 or 29 of each of the lugs 20 and 21 approximately corresponds to an associated edge 30 or 31 of each of the holding projections 9 or 10. There exists, however, a slight gap between the respective associated vertical edges 28 and 30 or 29 and 31, which forms a narrow slot 32 or 33 for the passage of the strap 3 between the interior and the exterior of the package.

The closing panel 18 of the front wall has a configuration which is not an exact replica of the configuration of the closing panel 19 of the rear wall. Rather, the front closing panel 18 is provided with an elongated central opening 34 including a slot 35 which has a transverse introduction enlargement 36 which is dimensioned with a view to permitting the passage of a hand of the person intending to carry or handle the package. In the assembled condition of the package and in the closed position of the front closing panel 18, the location of the opening 24 exactly corresponds to the location of a front portion of the strap 3 which, when it is pulled out through the opening 34, projects to the exterior of the package through the slot 35, due to the effect of a slight pressure resulting from the formation of a loop having a shape imposed on the strap 3 by the overall shape of the perimeter of the group of the bottles and the contact and guidance produced by the slots 32 and 33.

In a preferred version of the package of the present invention, the edges 26 and 27 of the lugs 20 and 21 for the front wall exactly correspond to upper edges of the front panel 18 which bound the opening 34. Furthermore, the lugs 20 and 21 for the front wall leave a sufficient space between themselves when folded to provide a passage aligned with the enlarged portion 36 of the opening 34, to provide a passage for the insertion of fingers behind the strap 3.

Figure 6:
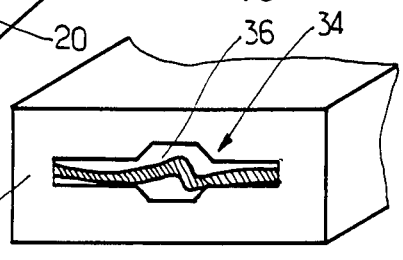
FIGS. 6, 7 and 8 are diagrammatic views corresponding to FIG. 5 and showing the shapes which the strap may assume in its retracted or folded state at the time of storage and prior to pulling thereat for the formation of a handle.
Figure 4:
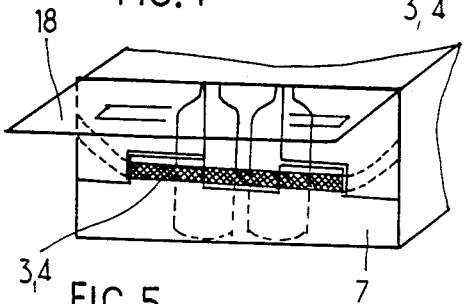
FIG. 4 is a view similar to FIG. 3 but with the front end portion in its condition assumed prior to its complete closure by pivoting and gluing a front panel.
Figure 8:
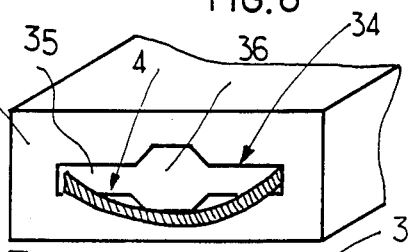
Figure 5:
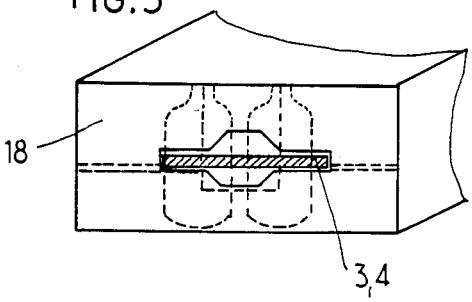
FIG. 5 is a view similar to FIG. 4 but with the front end portion in its condition assumed after its complete closure.
Figure 7:
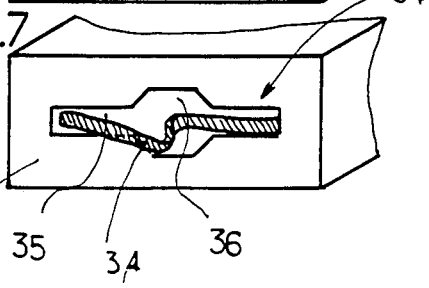

FIGS. 6, 7 and 8 illustrate the principal positions and shapes of the loop of the strap 3, which constitutes the handle 4 which extends transversely of the opening 34. In the position of storage, transportation or presentation for sale, the strap 3 assumes its retracted position within the opening 34, due to the pressure contact of the handle 4 with the rear wall of the adjacent package upon alignment. If the size of the slots 32 and 33 and the coverage by the panel 18 of the front wall are such as to let the strap 3 slide freely in the slots 32 and 33, the strap 3 assumes the shape and position which are shown in FIG. 6. On the other hand, if the slots 32 and 33 cause a certain pinching or clamping of the strap 3, the strap 3 will not be able to become folded back into the interior of the opening 34, which is shown in FIG. 7 of the drawing. Of course, all intermediate positions and shapes prove to be possible as a function of the effect sought. When handle 4 of the package is released by the consumer, the strap 3 is automatically retracted into the interior of the package through the slots 32 and 33 due to the elastic effect attributable to the original curvature of the strap 3.

Figure 12:
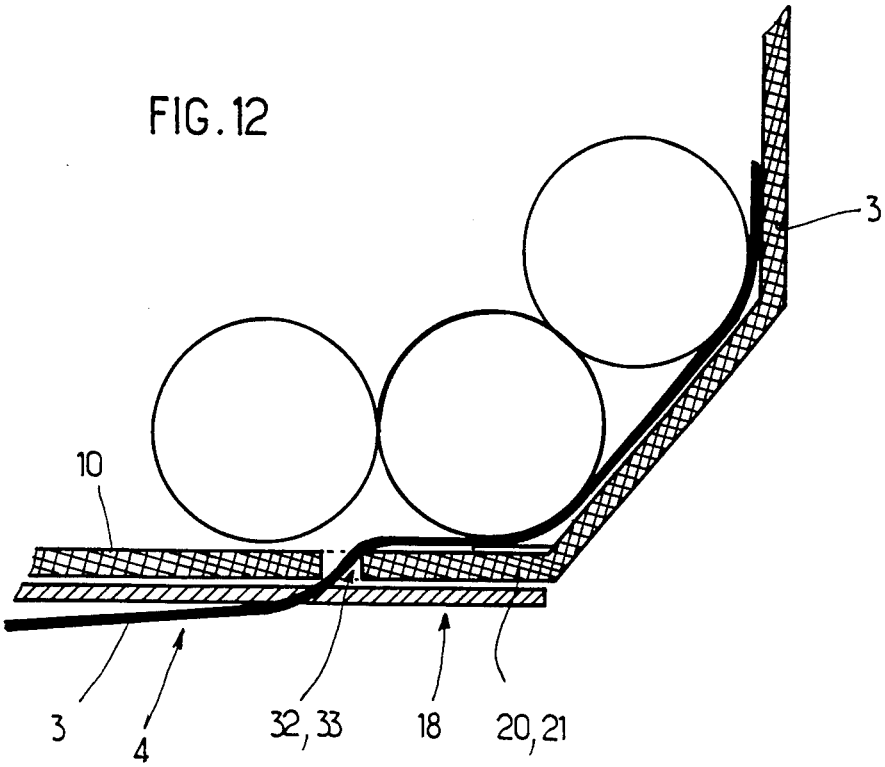
Figure 13:
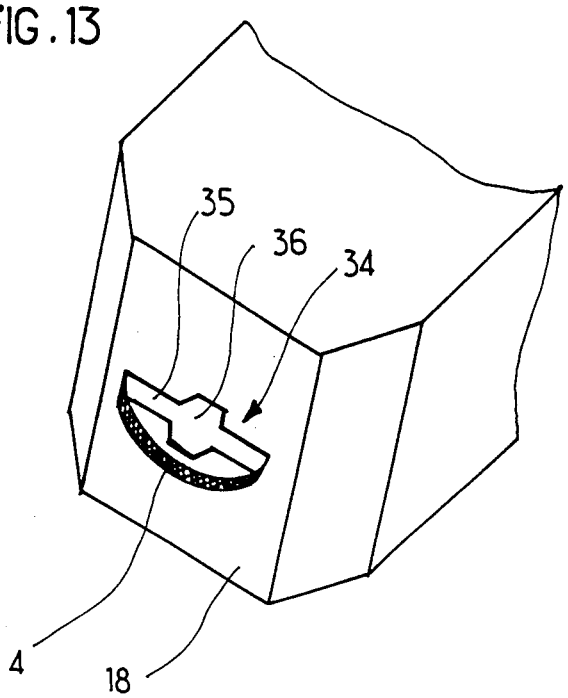
FIGS. 13 and 14 are views similar to FIG. 5 but showing examples of the application of the bevelled corner sections and of bevelled corner sections with chamfered corners, respectively, to the package according to the present invention.
Figure 14:
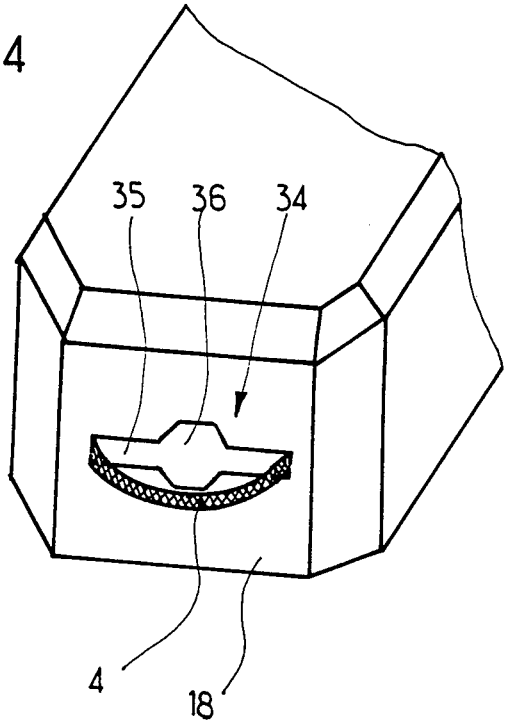

The present invention is applicable not only to packages whose covers 1 have parallelepiped configurations; rather, as shown in FIGS. 12 to 14, vertical corner regions 37 and 38 of the package may be chamfered, and/or at least the upper corner regions of the package may be bevelled as indicated at 39 to 43 in FIG. 14.

Having so described the construction of the package according to the present invention, the various phases of the manufacture of such package will now be explained in some detail.

The invention is related to a process which is equally applicable to the production of packages of many different configurations whose general idea consists in utilizing a tray-shaped package portion which serves for conforming a set or a group of containers in order to permit an easy positioning of the strap 3 loosely around such set or group of containers, the bottom wall and the peripheral walls of the tray-shaped package portion providing the stability and the cohesion which are required for the group of containers.

More particularly, the process according to the invention includes forming a group or set of the containers, placing this group or set onto a central zone of a tray-shaped package portion preform having raisable edge zones, raising the edge zones around the group or set of containers, and joining the raised edge zones with one another in order to form a rim which is adjusted or fitted to the dimensions of the group of the containers supported on the central zone, this rim constituting a true obstruction to the movement of the members or containers of the group, so as to achieve in this manner the required cohesion of the members of the group. This group, which is homogeneous and compact, lends itself easily to its confinement or tying or encircling by the flat strap 3 in preserving its initial cohesion during the tying or confining operation.

In a variation of the process, the above-mentioned rim is established, in such a manner as to be adjusted or fitted to the dimensions of the containers, prior to the introduction of the group of such containers in the space delimited by this rim with the aid of suitable mechanical means. The rim plays the same role in this case as before of maintaining the group of containers in place during the confining or tying or encircling operations. Thus, the tray-shaped portion of the package is being used here also as a conforming or confining element.

The packaging operation is then completed by the positioning of the cover or lid 1 on the bottom portion 2 in such a manner that the edge portions of the lateral panels 16 and 17 of the cover 1 become joined with the raised edge portions 5 and 6 of the tray-shaped bottom portion 1 of the package, by the closing of the rear wall, and by the gluing of the closing panel 18 of the front wall of the package. During the last-mentioned operation, the desired perfect superimposition and coincidence of the upper edges bounding the opening 34 with the lower edges of the lugs 20 and 21 of the front wall assists in correctly positioning the front panel 18. The requisite rigidity of the front wall is assured in this manner.

Even though the present invention has been described above on the basis of several particular exemplary structures, it is to be understood that the present invention is not intended to be, and should not be construed as being, limited to the details of such disclosed examples. Rather, all modifications and structural changes which are fairly suggested by the disclosure of the present application are to be considered as being encompassed by the present invention, so that the scope of protection of the present invention is to be determined exclusively from the appended claims.

What is claimed is:

1. A composite package for a group of articles, comprising a substantially tray-shaped bottom portion having a bottom wall and a plurality of upstanding edge walls which include a front edge wall and a rear edge wall having respective upper edges and which confine the group of articles supported on the bottom wall;

a cover portion connected to said bottom portion in an assembled condition of the package to cover said bottom portion and the group of articles and including a front wall which includes a front panel having an opening and two lugs extending along said front panel in a closed position of said front panel; said front panel;

an elongated endless strap received in the package and loosely surrounding the group of articles in the assembled condition of the package; and means at said upper edges of said front and rear edge walls for holding said strap in position on said bottom portion, said holding means said front edge wall defining with said lugs, respective slots for the passage of said strap therethrough and through said opening of said front panel between the interior and the exterior of the package in said assembled condition of the package and said closed position of said front panel for the strap to form a handle at the exterior of the package.

2. The package as defined in claim 1, wherein said holding means of said rear edge portion includes a central projection, and said holding means of said front edge portion includes two projections which are separated from one another by an indentation.

3. The package as defined in claim 1, wherein said holding means of said front edge portion includes two projections which are separated from one another by an indentation and have respective vertical edges; and wherein each of said lugs has a lower edge and is provided at said lower edge with a cutout having a configuration substantially identical to that of an associated one of said projections for receiving the same and being partially bounded by a vertical edge which defines one of said slots with said vertical edge of said associated projection.

4. The package as defined in claim 3, wherein said vertical edge of each of said lugs substantially corresponds to said vertical edge of said associated projection but is spaced therefrom by a distance defining the width of said one slot.

5. The package as defined in claim 3, wherein said lugs have such individual lengths that their cumulative length is smaller than the corresponding dimension of said front wall.

6. The package as defined in claim 3, wherein said lugs have such configurations as to bound an open area which is aligned with said indentation of said holding means of said front edge wall.

7. The package as defined in claim 1, wherein said opening of said front panel includes a slot having a centrally located enlargement.

8. The package as defined in claim 7, wherein said opening is partially bounded by an upper edge; and wherein each of said lugs has a lower edge which exactly corresponds to said upper edge of said opening in said closed position of said front panel.

* * * * *